United States Patent [19]

Kemper et al.

[11] 4,050,102

[45] Sept. 27, 1977

[54] RECIRCULATING TOILET SYSTEM

[75] Inventors: James M. Kemper; Robert J. O'Neill; Bruce E. Wagenhals; Jack W. Adams, all of Santa Monica, Calif.

[73] Assignee: Monogram Industries, Inc., Los Angeles, Calif.

[21] Appl. No.: 664,299

[22] Filed: Mar. 5, 1976

[51] Int. Cl.[2] ..... E03D 5/16

[52] U.S. Cl. ..... 4/10; 4/115; 210/109

[58] Field of Search ..... 4/8, 10, 11, 12, 69, 4/70, 76, 78, 80, 88, 90, 99, 100, 115, 119; 210/104, 109, 114

[56] References Cited

U.S. PATENT DOCUMENTS

| | | | |
|---|---|---|---|
| 2,670,848 | 3/1954 | Van Houten et al. | 210/109 |
| 3,829,909 | 8/1974 | Rod et al. | 4/10 |

*Primary Examiner*—Robert I. Smith
*Attorney, Agent, or Firm*—W. Poms

[57] ABSTRACT

Improvements in a recirculating toilet system wherein at least one human waste receiving receptacle, such as a urinal or toilet bowl, is provided coupled to a separating tank having a predetermined amount of a non-aqueous flushing fluid of a lower density and specific gravity than water therein. A flushing fluid intake floats on top of a layer of the flushing fluid in the tank with water and human waste below the layer. A motor-activated pump flushing fluid recirculating means is coupled to both the intake and the receptacle for withdrawing flushing fluid from the layer in the tank and flushing the receptacle. The float has a detector for detecting the presence of a predetermined amount of wastewater in the flushing fluid being withdrawn from the tank for flushing the receptacle and for detecting the level of the flushing fluid in the tank and deactivates the pump of the recirculating means when this predetermined amount of wastewater is detected.

8 Claims, 2 Drawing Figures

RECIRCULATING TOILET SYSTEM

BACKGROUND OF THE INVENTION

1. Field of the Invention

The invention relates to recirculating toilets; and, more particularly, to improvements in recirculating toilets wherein a float member withdraws flushing fluid from a layer of flushing fluid floating on top of human waste in a separating tank.

2. Description of the Prior Art

In U.S. Pat. No. 3,829,909 to Rod et al., a recirculating toilet system is disclosed wherein human waste is receiving from a receptacle, such as a toilet bowl, and removed to a separating tank which is initially charged with a flushing fluid of lower density and specific gravity than water. The flushing fluid thus floats as a layer on top of the waste and a float member floats on top of the layer. Means are provided for withdrawing flushing fluid through the float and utilizing the flushing fluid to flush the receptacle or receptacles. Thus, the flushing fluid is continuously recycled between the separating tank and the receptacle or receptacles and may pass through suitable filters or the like for filtering undesirable particles out of the flushing fluid. Obviously, such filters or the like would become quickly clogged with undesirable particles removed from the flushing fluid if the fluid was not relatively "clean" when withdrawn from the tank. If too much water or other undesirable elements are present in the flushing fluid withdrawn from the tank, it could quickly destroy the entire system by clogging pump gears, the filters, etc.

Further, should some component in the system break down, there is no way to safeguard the system of Rod et al. should the pump begin withdrawing water and other undesirable elements along with the oil. There is thus a need for a means for detecting when water is present in the flushing fluid in such recirculating toilet systems and deactivating the same when such water is present.

SUMMARY OF THE INVENTION

It is an object of this invention to provide an improved recirculating toilet system.

It is a further object of this invention to provide a recirculating toilet system which includes a float for withdrawing flushing fluid from a layer floating on top of human waste and means associated with the float for detecting the presence of any wastewater in the flushing fluid being withdrawn.

It is still another object of this invention to carry out the forgoing objects in a manner whereby the system is deactivated if presence of wastewater is detected in the flushing fluid.

It is even further an object of this invention to provide a system which detects the depth of a layer of flushing fluid floating on top of human waste in a collection or separating tank.

These and other objects are accomplished by providing a recirculating toilet system wherein at least one human waste receiving receptacle, such as a urinal or toilet bowl, is provided coupled to a separating tank having a predetermined amount of non-aqueous flushing fluid of a lower density and specific gravity than water therein. A flushing fluid intake floats on top of a layer of the flushing fluid in the tank with wastewater and human waste below the layer. A motor-activated pump flushing fluid recirculating means is coupled to both the intake and the receptacle for withdrawing flushing fluid from the layer in the tank and flushing the receptacle. The float has a detector for detecting the presence of a predetermined amount of wastewater in the flushing fluid being withdrawn from the tank for flushing the receptacle and for detecting the level of the flushing fluid in the tank and deactivates the motor of the recirculating means when this predetermined amount of wastewater is detected.

DESCRIPTION OF THE PREFERRED EMBODIMENT

Figure 1:
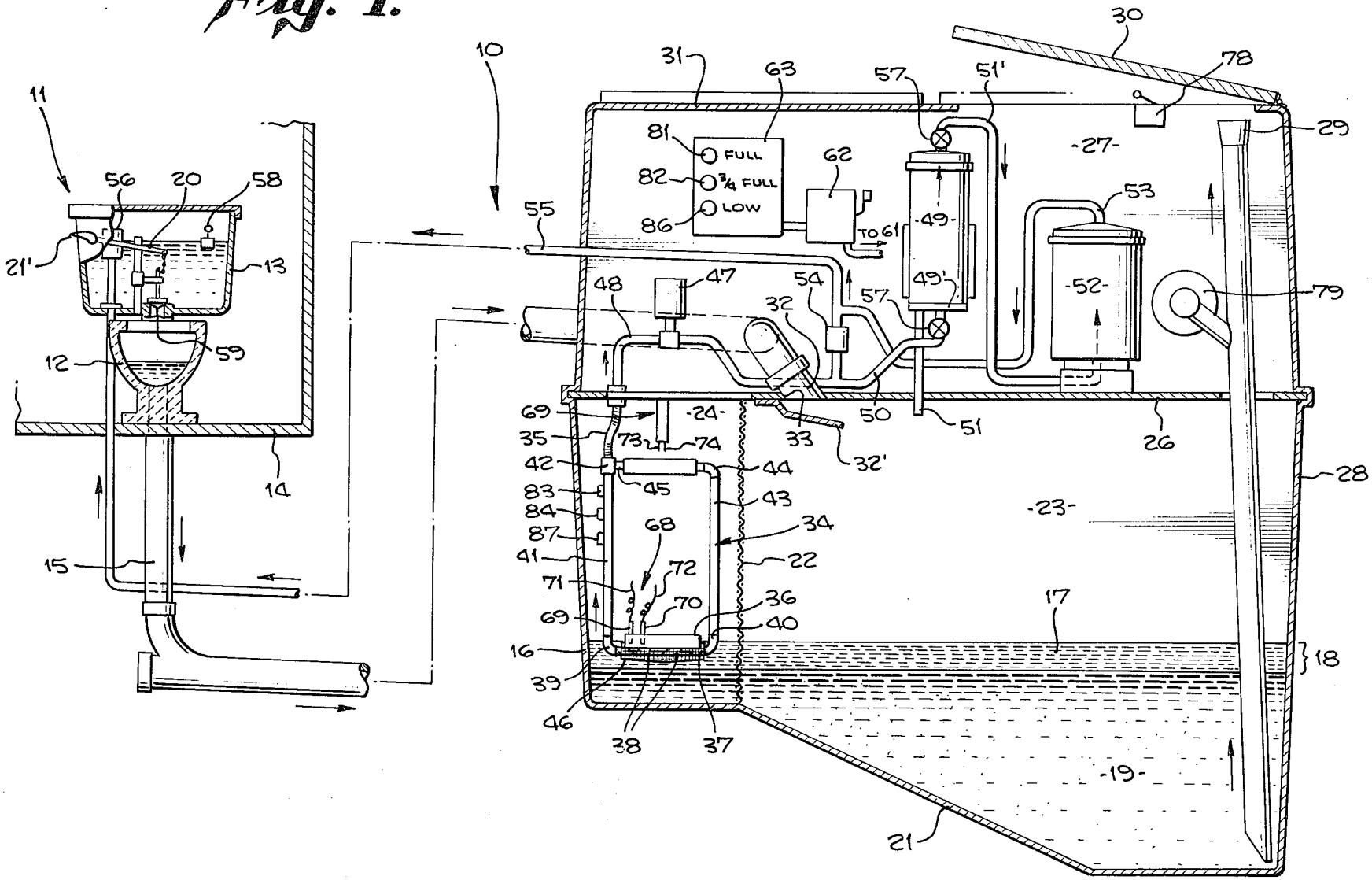
FIG. 1 is a diagrammatic illustration of a toilet system in accordance with the teaching of the invention.

Referring now to FIG. 1 of the drawing, there is illustrated a recirculating toilet system 10 in accordance with the present invention. The system 10 includes a human waste receptacle such as a toilet 11 having a toilet bowl 12 with an attached tank 13 mounted on a floor or other supporting surface 14. Bowl 12 is connected to a waste pipe or line 15, which empties into a separating tank 16. Normally, tank 16 is initially charged with a predetermined amount of flushing fluid 17 which floats as a layer 18 on top of the human waste 19 being emptied from bowl 12 into tank 16.

Although only one toilet 11 has been described, obviously more than one toilet may be provided emptying into tank 16 as is well known in the toilet art. Further, although a toilet 11 has been described as the human waste receptacle, obviously other receptacles may be used, such as urinals, etc. In fact, system 10 may be comprised of a plurality of toilets and urinals, all emptying into tank 16 through a common manifold and all flushed with flushing fluid through a common flushing manifold, as, for example, described in the aforementioned patent to Rod et al.

The separating tank 16, in the preferred embodiment, has a tapered side 21 at the bottom thereof and thus is wider at the top than at the base. A filter screen 22 vertically divides the separating tank 16 into two sections, a solids collecting section 23 and a filtered flushing fluid section 24. Screen 22 is of a mesh sufficiently fine to prevent the passage of most waste solids and paper products that are normally found in a toilet system.

The fluid component of the waste, however, can of course pass through the screen 22. In the solids collecting section 23, a pump out tube 25 opens into the lowermost portion of tank 16 and extends out of section 23, through a partition 26 dividing tank 16 into an upper compartment 27 and the aftermentioned section 23, and terminates in upper compartment 27. The open upper end of tube 25 is normally closed by a removable cap 29, access to cap 29 being provided by a hinged panel 30 in the top wall 31 of tank 16. It can be seen that the sewage in the lowermost portion or section 23 of tank 16 may be selectively pumped out through tube 25, when desired.

Waste line 15, as discussed, interconnects the bowl 12 with tank 16. Line 15 may be one continuous pipe or sectioned as shown, terminating at tank 16 in an inlet pipe 32 extending through an opening 33 in partition 26 and angled so as to direct waste into tank 16 at a slight angle to the horizontal plane of the layer 18 so as to minimize disturbance. A ramp 32' may be provided mounted on partition 26 receiving waste thereon to assist in minimizing such disturbance.

In the flushing fluid section 24 of tank 16, intake float means 34 is provided. Float means 34 is pivotally mounted through a flexible coupling 35 to partition 26. Float means 34 included a float portion 36 which may be of substantially rectangular shape and of a suitable float material, such as foam or other light but bulky material with high flotation qualities. Float portion 36 may be of any suitable dimensions, such as about five by ten inches in width and length and one inch in thickness. Located within float portion is an intake pipe 37 having a plurality of holes 38 for drawing surface flushing fluid into pipe 37. Pipe 37 may be pivotally mounted in 90° elbows 39, 40 at each end in any suitable manner so as to keep the float portion 36 in contact with the surface of layer 18 as the level changes. Elbow 39 is coupled to a pipe section 41 which is in turn coupled to a Tee-joint 42. Elbow 40 is coupled to a pipe section 43 which is in turn coupled to an elbow 44. A cross-pipe 45 interconnects Tee-joint 42 to elbow 44. The open end of Tee-joint 42 is coupled to the aforementioned flexible tubing 35.

All the tubings and joints are hollow for conveying flushing fluid from layer 18 through tubing 35. A screen 46 may be provided along the bottom of float means 34 to thereby insure that only the surface portion of flushing fluid 17 will be drawn into intake orifices or holes 38 in intake pipe 37.

Flushing fluid recirculating means may be provided for recirculating fluid 17 from tank 16 to toilet 11. Such means may include a conventional motor and pump 47 having its pump input in fluid communication with tubing 35 through interconnected tubing 48 and its pump output in fluid communication with a conventional coalescer 49 through interconnected tubing 50. A drain line 51 may be provided at coalescer 49 opening into the solids section 23 of tank 16 for draining off any water or liquid waste removed at coalescer 49 back to tank 16.

Since it is desirable to purify the recirculating flushing fluid so that it does not take on undesired colors and/or odors, in addition to coalescer 49, which first removes suspended solids and water particles from the flushing fluid, the fluid may be flowed from coalescer 49 through tubing 51' and into a suitable filter 52. From filter 52, the fluid may be flowed through tubing 53 to a flushing fluid recirculating line 55 leading to a fill tube 56 in the interior of toilet tank 11. A bypass valve 54 may be provided between line 50 and 55 if too much pressure builds up in the filter, so as to bypass the same so fluids can go directly to tank 11 through line 55. Suitable check valves 57 may be provided at various locations in system 10.

Before discussing the novel detecting means of system 10 for detecting the pressure of wastewater in the flushing fluid, the operation of system 10 will be discussed.

Normally, waste products deposited in bowl 12 will pass through outlet 15 and enter tank 16 through inlet 32. Solids in the waste will be retained in section 23 due to the vertical filter screen 22. Of course, such screen 22 need not be vertically mounted and other separating means may be provided. The liquid portion of the waste passes through screen 22 into section 24 and forms a liquid phase below the layer 18 of flushing fluid 17 initially deposited in tank 16. Depending on the dimensions of tank 16, it may be assumed that tank 16 will hold sufficient flushing fluid to fill toilet tank 11, provide a fluid charge standing in bowl 12 and provide a sealing layer over the waste products with a reserve of fluid.

When the toilet is flushed by depressing flush handle 20', the closet tank lever 20 rises and lifts the ball valve 59 in tank 11 to empty the flushing fluid in tank 11 to bowl 12. When the level of flushing fluid in tank 11 falls below a predetermined level, the motor pump 47 is energized by float switch 58. Flushing fluid 17 is withdrawn from tank 16 through means of the orifices 38 in intake pipe 37. When the flushing fluid in tank 11 has emptied, ball valve 59 closes and allows tank 11 to fill with flushing fluid 17 until it reaches a predetermined level which will de-energize motor pump 57 by float switch 58. This flushing fluid 17 may include some fine particles of paper or other foreign matter that have neither settled out nor have been excluded by screen filter 22. Thus, the fluid passes through flexible tubing 35 and enters coalescer 49 and the paper and other foreign particles are collected within the filter element of the coalescer 49'. Coalesced liquid waste and water are returned to the waste section 23 of tank 16 through drain line 51. If desired, a particulate filter 49' may be provided before coalescer 49 to remove particulate matter from the fluid.

As described in the aforementioned Rod et al patent, intake pipe 37 is arranged to withdraw flushing fluid from a point near the surface, avoiding contamination by the liquid waste component which may be found in tank 16. Although only a single toilet 11 and means for operating the same is described, a motor and pump 47' may be provided in system 10 (not visible in FIG. 1 but shown schematically in FIG. 2) which motor and pump 47' leads to a urinal (not shown) or the like and the various components of the circuit for operating system 10 as will be described in detail.

As particularly contemplated in the present invention, detecting means 60 are provided for detecting the presence of any wastewater in the flushing fluid 17 being withdrawn from tank 16. In the exemplary embodiment of the invention, such detecting means 60 is shown diagrammatically in FIG. 1 and schematically in FIG. 2. Detecting means 60 includes a suitable source of power 61, such as 110/120 volts, 60 hz, one phase AC current or 24 volts direct current. Suitable apparatus is provided for disconnecting the power source 61 to service system 10 and disconnect the same during periods of non-use. Such apparatus is indicated at box 62 and may include therein branch circuit overcurrent protection, such as fuses or circuit breakers or the like, to provide protection for system 10 in the event of an overcurrent condition. As can be seen in FIG. 1, a control panel 63 includes therein various components as to be described and shown schematically in FIG. 2. Thus, control panel 63 includes therein a controller 64 for controlling the motor of motor and pump 47' for the urinal and may also have suitable means therein for overcurrent protection. Any suitable controller may be used, such as a magnetic motor starting relay. Overcurrent protection may be provided by an indirectly heated, manually reset thermal over-current relay which would provide protection for the motor of motor and pump 47' in the event of an overcurrent condition.

A similar controller 65 may be provided in panel 63 for the toilet motor and pump 47. If an AC power source as described is used, both motors may be any suitable type, such 110/120 volt, 60 hz, 1-phase, ⅓ H.P., 1725rpms, with capacitor start, totally enclosed and fan cooled, and close coupled to a hydraulic gear pump with internal relief. If DC current is used as the power source, any suitable motor and pump may be used, such as a 24 volt direct current motor having ⅓ H.P. and 1725 rpms, permanent magnet, 2-pole, totally enclosed and non-ventilated and close-coupled to a hydraulic gear pump with internal relief.

Figure 2:
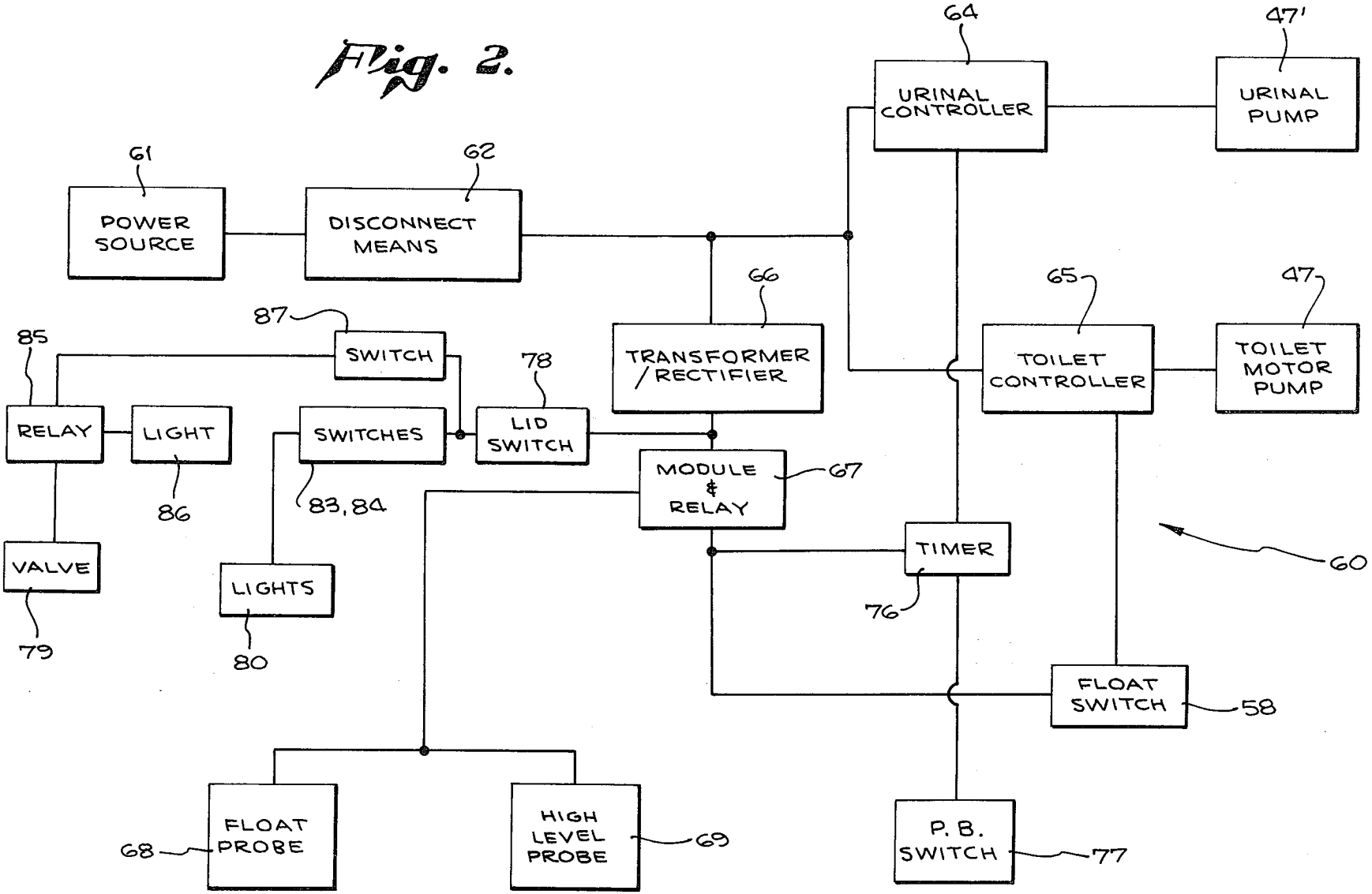
FIG. 2 is a schematic illustration of a control system for the toilet system of FIG. 1.

Both controllers 64, 65 are coupled to disconnect means 62 as shown in FIG. 2 and to their respective motor and pumps 47, 47'.

Optionally, control panel 63 may also include a control voltage transformer/rectifier 66 coupled between disconnect means 62 and controllers 64, 65 for reducing and rectifying 110/120volts, 60 Hz, to 24 volts, direct current, for use as the voltage for the circuit of FIG. 2 if the power supply is A.C. Of course, this unit 66 may be eliminated if a D.C. power supply as described is used.

Control panel 63 also includes probe means in the form of a sewage probe module and relay 67 coupled to unit 66 for detecting the presence of wastewater in the flushing fluid 17 at a probe 68, to be described, connected thereto. Module and relay 67 is also coupled to a high level probe 69, also to be described, and is adapted to break the control voltage to the controllers 64, 65 thus inactivating motor and pumps 47, 47'.

As can be seen in FIG. 1, float probe 68 is located at the float portion 36. Preferably, probe 68 comprises a pair of spaced stainless steel rods 69, 70 with wires 71, 72 are connected to module and relay 67 in panel 63. This is shown schematically in FIG. 2. When sewage, i.e. wastewater in the flushing fluid 17, touches probe 68, system 10 becomes inoperative as discussed with respect to the probe module relay 67.

The high level probe 69 of the probe means is located on partition 26 and extends downwardly as shown in FIG. 1 and in position to be contacted by the liquids in tank 16. Probe 69 preferably comprises a pair of spaced stainless steel buttons 73, 74 attached to and depending downwardly from a plastic rod 75 which, as discussed, extends into the sewage area in tank 16. A pair of wires (not shown) are coupled to buttons 73, 74 which are in turn coupled to the module and relay 67, as shown schematically in FIG. 2. When the level of sewage, i.e. any wastewater in the flushing fluid 17, reaches buttons 73, 74 the system 10 becomes inoperative as heretofore described.

Control panel 63 also includes suitable timing means, such as a timer 76 coupled to both controller 65 and module and relay 67 to provide an off-delay of a predetermined period of time, such as ten seconds, from the time a push button switch 77 of the urinal is released. This switch 77 is coupled to timer 76 and may be a momentary contact switch which, when pushed and held, provides continuous urinal flush but, when released, the inactivation of the motor and pump 47' is delayed for the aforementioned period of time. Switch 77 is not shown in FIG. 1 but is preferably located at the urinal (not shown).

The aforementioned float switch 58 at toilet 11 is coupled to the toilet controller 65, timer 76 and the module and relay 67. This switch 58 may be any suitable type, such as a magnetic float, reed-type switch which is located in the toilet tank 13 at the flushing fluid level. When toilet 11 is flushed, the float switch 58 follows the fluid level down, say ½, and energizes the controller 65. Flushing fluid then enters tank 13 until it reaches the float therein which de-energizes the controller 65.

Optionally, a tank lid switch 78 may be coupled to both unit 66 and unit 67 (FIG. 2) and located under the tank lid 30 (FIG.1) which is activated when lid 30 is opened. This switch 78 is adapted to energize a pumpout system vacuum regulator/breaker valve 79, as will be discussed, and the holding tank level indicating lights 80 mounted in panel 63, as will also be discussed.

Thus, holding tank level indicating lights 80 are located on panel 63 and include a "full" indicator light 81 and a "three-fourths full" indicator light 82. These lights 81, 82, of course, indicate the level of sewage in tank 16.

Valve 79 may be any suitable valve, such as a solenoid-operated balanced diaphragm and spool, pilot-operated. During pumpout, valve 79, also shown in FIG. 1, as coupled to pumpout tube 25, regulates the vacuum (e.g., 6.5 in Hg) in tank 16 and, when sewage is brought to the low level, the solenoid of valve 79 de-energizes which actuated the value portion of valve 79 and completely breaks the vacuum and terminates pumpout.

A pair of level indicating switches 83, 84, such as conventional mercury switches, are located on float arm or pipe section 41, as shown in FIG. 1, and indicate the "full" and "three-fourths full" level, respectively. These switches 83, 84, as shown schematically in FIG. 2, are operatively connected between lights 80 and lid switch 78, and thus units 66 and 67, and energize the level indicating lights 81 and 82.

A vacuum regulator and breaker control relay unit 85 on panel 63 is operatively connected to both valve 79 and between switches 83, 94 and switch 78 and thus units 66, 67. This unit 85 energizes either the vacuum regulator and breaker solenoid of valve 79, coupled thereto, or the low level indicating light 86, coupled thereto, to be described.

A level indicating (low) and vacuum regulator and breaker valve control relay mercury switch 87 is located on float section 41 (see FIG. 1) and energizes the low level indicating light 86, coupled thereto (FIG. 2) and to relay 85. The aforementioned holding tank low level indicating light 86 is located in panel 63 (FIG. 1) and is coupled to relay 85, as previously discussed, and indicates the low level of sewage in tank 16.

In the foregoing system, any suitable components may be used that are necessary to carry out the system. All individual components are well known in the recirculating toilet art. It can be seen that there has been disclosed a recirculating toilet system which includes detecting means for detecting the presence of wastewater in the flushing fluid, and thus the level of the flushing fluid, and deactivating the system when a predetermined amount of wastewater is so detected.

Accordingly, if the intake means 34 is picking up a predetermined amount of wastewater in the sewage, it will destroy system 10 since the wastwater or sewage will corrode the components, such as the pump, filter, etc. and load up the filtering system thereby shortening its life.

The flushing fluid which settles as a layer 18 on top of the sewage may be about four or four and one-half inches or so. If the float portion 36 of intake means 34 became so saturated that it sank down into layer 18, or if there was a malfunction and sewage 19 reached intake pipe 37, wastewater or sewage would be picked up along with the flushing fluid. Thus, in the invention described, sewage is kept out of the filtering system. When the sewage touches the probe means 68, because of the difference in resistance between wastewater or sewage and the flushing fluid, such as a mineral oil which is well known in the recirculating toilet art, the relay means 67 is triggered. If the sewage reaches probes 73, 74, the relay means 67 is also triggered. In both cases, failure of the system is prevented by automatic shut-down.

We claim:

1. In a recirculating toilet system comprising at least one human waste receiving receptacle, separating means including a separating tank coupled to said receptacle for receiving human waste therefrom, a layer of non-aqueous flushing fluid, substantially immiscible with water and human waste and having relatively lower density and specific gravity and a conductivity different than water, disposed in said tank, flushing fluid intake means in said separating tank including a float member capable of floating substantially at the surface of said flushing fluid for withdrawing flushing fluid therefrom, and motor activated flushing fluid recirculating means coupled to both said intake means and said receptacle for withdrawing flushing fluid from said tank into said receptacle, the improvement which comprises:

detecting means associated with said intake means for detecting the presence of wastewater in the flushing fluid adjacent said intake means and deactivating the motor of said recirculating means when the presence of a predetermined amount of wastewater is detected in said flushing fluid, said detecting means including a pair of spaced probes extending down into said flushing fluid to a depth at least normally above the interface between said flushing fluid and said water and human waste, and circuit means operatively connecting each of said probes to said motor creating a potential across said probes normally retaining said motor in operative condition when said probes contact said flushing fluid and said circuit means further including sensing means adapted to sense the current flow between said probes and deactivate said motor when the sensed current between the probes indicates the presence of sufficient water and human waste therebetween.

2. In the toilet system of claim 1 wherein said detecting means includes second probe means associated with said separating tank and above and remote from said intake means adapted to detect the presence of wastewater in said flushing fluid at an uppermost portion of said separating tank.

3. In the system of claim 1 including level indicating means associated with said separating tank for indicating the level of the contents of said separating tank.

4. In the system of claim 1 including pump-out means associated with said separating tank for selectively pumping sewage out of said separating tank.

5. In a recirculating toilet system comprising at least one human waste receiving receptacle, separating means including a separating tank coupled to said receptacle for receiving human waste therefrom, a layer of non-aqueous flushing fluid, substantially immiscible with water and human waste and having a relatively lower density and specific gravity and of a conductivity different from that of water, disposed in said tank, flushing fluid intake means in said separating tank including a float member capable of floating substantially at the surfce of said flushing fluid for withdrawing flushing fluid therefrom, and the motor activated flushing fluid recirculating means coupled to both said intake means and said receptacle for withdrawing flushing fluid from said tank into said receptacle, the improvement which comprises:

a circuit having a source of power, said source of power being operatively connected to said motor, disconnect means operatively connected between said motor and said source of power for selectively activating and inactivating said motor, probe means associated with said intake means operatively connected to said disconnect means adapted to detect the presence of wastewater in said flushing fluid and provide a signal to said disconnect means to inactivate said motor when the presence of wastewater is detected in said flushing fluid, said probe means including a pair of spaced probes extending down into said flushing fluid to a depth at least normally above the interface between said flushing fluid and said water and human waste, said circuit operatively connecting each of said probes to said disconnect means creating a potential across said probes normally retaining said motor in operative condition when said probes contact said flushing fluid and said circuit means further including sensing means adapted to sense the current flow between said probes and deactivate said motor when the sensed current between the probes indicates the presence of sufficient water and human waste therebetween.

6. In the system of claim 5 wherein second probe means is disposed in said separating tank above said float member floating at the surface of said flushing fluid and operatively connected to said disconnect means for detecting the presence of wastewater in said flushing fluid at a level in said separating tank higher than said float member.

7. In the system of claim 5 including actuating means opertively connected to both said receptacle and said motor for selectively actuating the same, and timing means operatively connected to both said motor and said actuating means for providing inactivation of said motor after a predetermined period of time after said actuating means is released to thereby activate said motor.

8. In the system of claim 5 wherein said separating tank includes a normally closed pump-out tube extending down into the bottom of said separating tank and opening in a chamber above said separating tank and normally sealed therefrom, control means associated with said tube for controlling the pump-out of sewage within said separating tank, said chamber having a closable lid for providing access to said normally closed pump-out pump, and switch means associated with said lid and operatively connected to both said disconnect means and said vacuum means adapted to activate said disconnect means to deactivate said motor and energize said control means to pump sewage out of said separating tank and terminate the pump-out of said tube when a predetermined level of sewage in said separating tank is reached.

* * * * *